US006040753A

United States Patent [19]

Ramakrishnan et al.

[11] Patent Number: 6,040,753

[45] Date of Patent: Mar. 21, 2000

[54] ULTRA-LOW-PROFILE TUBE-TYPE MAGNETICS

[75] Inventors: Sriram Ramakrishnan, Clifton Park; Robert Louis Steigerwald; William Hull Bicknell, both of Burnt Hills, all of N.Y.

[73] Assignee: Lockheed Martin Corp., Moorestown, N.J.

[21] Appl. No.: 09/287,157

[22] Filed: Apr. 6, 1999

[51] Int. Cl.[7] ..... H01F 5/00; H01F 27/28

[52] U.S. Cl. ..... 336/223; 336/206; 336/200; 336/232

[58] Field of Search ..... 336/223, 206, 336/200, 232

[56] References Cited

U.S. PATENT DOCUMENTS

| | | | |
|---|---|---|---|
| 3,719,911 | 3/1973 | Tomita | 336/196 |
| 4,342,976 | 8/1982 | Ryser | 336/84 R |
| 4,383,235 | 5/1983 | Layton et al. | 336/200 |
| 4,509,109 | 4/1985 | Hansen | 336/126 |
| 5,525,951 | 6/1996 | Sunano et al. | 336/160 |
| 5,561,410 | 10/1996 | Toki | 336/200 |

FOREIGN PATENT DOCUMENTS

| | | | |
|---|---|---|---|
| 54-057405 | 11/1980 | Japan | 336/200 |
| 56-151546 | 3/1983 | Japan | 336/200 |

OTHER PUBLICATIONS

"A Comparative Study of Low–Profile Power Magnetics for High–Frequency, High–Density Switching Converters", by Ramakrishnan et al., published at pp. 388–394 of vol. 1 of APEC '97, the proceedings of the Annual Applied Power Electronics Conference & Exposition, sponsored by the IEEE, Feb. 23–27, 1997.

*Primary Examiner*—Michael L. Gellner
*Assistant Examiner*—Anh Mai
*Attorney, Agent, or Firm*—W. H. Meise; S. D. Weinstein

[57] ABSTRACT

A low-profile transformer or inductor includes a leg of a magnetically permeable core. A tube-type winding arrangement is made by use of a flat, flexible dielectric sheet, on one side of which a broad conductive area is affixed, and on the other side of which a plurality of mutually parallel elongated regions are affixed. The dielectric sheet is rolled into a tube defining a parting line which is perpendicular to the axes of elongation of the conductive strips. The discontinuous elongated strips are formed into a continuous winding by means of stitches. The stitches may be through vias extending through overlapping regions of the tube to interconnect ends of the strip conductors, or may be generated by an HDI conductor overlying the ends of the strip conductors, with through vias making connections to the ends of the strip conductors and to HDI conductors.

11 Claims, 11 Drawing Sheets

MULTI-POLE CORE DESIGN FOR TUBE TYPE MAGNETICS

ULTRA-LOW-PROFILE TUBE-TYPE MAGNETICS

FIELD OF THE INVENTION

This invention relates to transformers having a flat profile, and which are suited to fabrication using printed or high-density-interconnect (HDI) techniques.

BACKGROUND OF THE INVENTION

Modern electronics systems are increasingly making use of low supply voltages. For example, digital processors at one time used voltages of ten or more volts, but the supply voltages have decreased over the years, and are now often in the 3-volt region. Nevertheless, the power consumption has remained substantially constant. Thus, direct supply voltages have tended to decrease, and currents have tended to increase. Transformers which produce such low voltages from alternating-current lines tend to become less efficient as the transformation ratio increases. One of the problems associated with transformer design is to maintain high efficiency at lower direct supply voltages, but at the same power.

The requirements of modern equipment tend to favor smaller and lighter-weight designs. Computers, for example, require low voltages and high currents, and the desire for portability of computers creates a powerful incentive for small and lightweight power supplies. Concomitant and even more severe requirements are placed on power supplies for use on spacecraft. Higher switching frequencies than the normal 60 Hz power-line frequency have been used over the years in order to achieve smaller volume and overall dimensions in switching converters. For example, present-day switching power supplies often use switching frequencies greater than 0.5 MHz.

Power transformers have been made using disk-like winding structures, as detailed in an article entitled "A COMPARATIVE STUDY OF LOW-PROFILE POWER MAGNETICS FOR HIGH-FREQUENCY, HIGH-DENSITY SWITCHING CONVERTERS", by Ramakrishnan et al., published at pp 388–394 of Volume 1 of APEC '97, the proceedings of the Annual Applied Power Electronics Conference and Exposition, sponsored by the IEEE, Feb. 23–27, 1997. The disk-type structures are made up of a plurality of dielectric layers, which are stacked vertically. Each of the dielectric layers has a central aperture which fits over the magnetic core. Each layer of the dielectric carries a pattern of conductor windings which loops around the central aperture, so as to define one or more windings about the core when the structure is assembled. The constraints of available materials and fabrication techniques results in a profile having a height of greater than 0.15 inch for viable magnetic designs. Some requirements are for profiles of less than 0.1 inch to satisfy packaging requirements.

Tube-type windings are also described in the abovementioned Ramakrishnan article. The tube-type windings therein described include a magnetically permeable core with an E-section and an I-section, together defining a single pole or center post. The primary and secondary windings are in the form of a flat tube dimensioned to fit over the center post of the E-section of the core. This type of winding is reported to produce 50 watts in a structure no larger than a quarter-dollar coin.

Improved planar transformer structures are desired.

SUMMARY OF THE INVENTION

A magnetically coupled winding structure, such as a transformer or inductor, according to an aspect of the invention, includes a flat, magnetically permeable core including a flat first portion defining first and second broad sides and at least one peripheral edge. The flat, magnetically permeable core also defines at least a first slot extending inward from the edge, to thereby define a central core portion lying generally adjacent the first slot, and to also define at least a side core portion extending parallel with the central core portion. The magnetically permeable core further includes a flat, magnetically permeable end portion coplanar with the first portion and magnetically coupled to the central core portion and to the first side core portion at a location adjacent the end of the slot. The transformer or inductor also includes a dielectric sheet defining first and second broad, flat, mutually opposed sides. The dielectric sheet includes a first electrically conductive layer affixed to at least a substantial portion of the first side, and further includes a second layer affixed to the second side of the dielectric sheet. The second layer includes a plurality of mutually isolated elongated second electrical conductors. Each of the plurality of mutually isolated elongated second electrical conductors defines first and second ends, and an axis of elongation extending between the first and second ends. The axes of elongation of the second electrical conductors are generally parallel. The dielectric sheet is generally curved to define a cylinder-like structure. The dielectric sheet, so curved, defines a structure having the general shape of a flat tube having or defining first and second ends, and having the first side of the dielectric sheet on the inner side or inside of the flat tube. The flat tube defines a central axis, and is dimensioned to fit over the central core portion, with the first end of the tube adjacent the juncture of the central core portion with the side core portion, and with the second end of the tube adjacent the end portion of the core. With such a curvature of the dielectric sheet, the first electrically conductive layer is formed into an electrically open single turn about the central core portion. In this context, electrically open means that no current can flow in the single turn as a result of magnetic flux variation in the central core portion, because there is no complete path for the flow. The curvature of the dielectric sheet also curves the elongated second conductors, so that each of the second electrical conductors defines an open single turn about the central core portion, with a first end of each of the elongated second electrical conductors generally adjacent to or contiguous with a second end thereof. The first and second ends of the second electrical conductors are substantially coplanar with one of the first and second broad sides of the magnetically permeable core when the tube is fitted over the central portion of the core. The transformer or inductor also includes a flexible interconnection sheet overlying the one of the first and second sides of the magnetically permeable core and the first and second ends of the second elongated electrical conductors. The flexible interconnection sheet includes a layer of electrically conductive material defining at least interconnections between the first and second ends of the elongated second electrical conductors. These interconnections are defined in a manner which electrically interconnects at least the first end of one of the elongated second electrical conductors to the second end of a nearby one of the elongated second electrical conductors, to thereby define a single continuous electrical conductor wound in multiple turns about the central core portion. An electrically conductive arrangement is electrically coupled to mutually adjacent portions of the electrically conductive first layer, to thereby define electrical connection terminals for the single turn of electrical conductor about the first central core portion of the magnetically permeable core. These terminals may be in the form of projecting tabs, which preferably are located at one or the other ends of the tube.

In a particularly advantageous embodiment of the invention, the flat, magnetically permeable core further defines at least a second slot extending inward from the edge, parallel with the first slot, to thereby define a second side portion lying generally adjacent the second slot. The second side portion lies parallel with the central core portion, and the flat, magnetically permeable end portion is coplanar with the central portion of the magnetically permeable core and with the first and second side portions of the magnetically permeable core.

In one version of the transformer or inductor according to the invention, the interconnections of the interconnection sheet are defined in a manner which electrically interconnects at least the first end of one of the elongated second electrical conductors to the second end of an adjacent one of the elongated second electrical conductors, to thereby define a single continuous electrical conductor wound in multiple turns about the central core portion.

DESCRIPTION OF THE INVENTION

Figure 1:
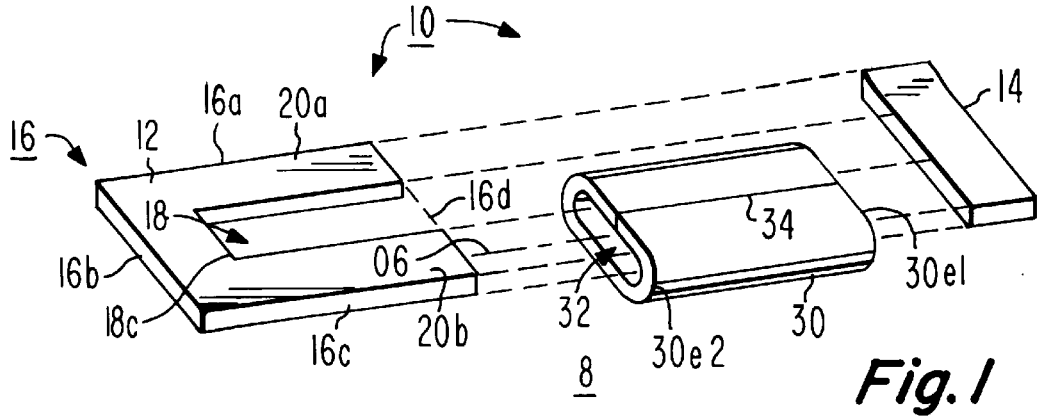
FIG. 1 is a simplified perspective or isometric, exploded view of a transformer or inductor with a U-I core according to an aspect of the invention.

In FIG. 1, a magnetically permeable core 10 includes a U-portion 12 and an I-portion 14. U-portion 12 may be viewed as being a flat piece defining a peripheral edge 16 with portions 16*a*, 16*b*, 16*c*, and 16*d*, and a notch 18 cut into the flat piece from edge 16*d* to thereby divide the flat piece into two elongated, mutually parallel legs 20*a* and 20*b* joined at a closed end 18*c* of slot 18. The I piece 14 of core 10 is dimensioned to fit across the ends of legs 20*a* and 20*b*, and, when assembled, to be coplanar with the flat U portion 12 of the core. FIG. 1 also illustrates a flat tube 30, which defines an aperture 32. The dimensions of tube 30 are selected such that the tube aperture 32 fits over leg 20*b*, and its length is no greater than the length of leg 20*b*, so that the I portion 14 of the core 10 can be juxtaposed with the ends of the legs 20*a* and 20*b* when the tube is in place on leg 20*b*. Tube 30 also defines a parting line 34. As described below, tube 30 carries the windings which, in conjunction with core 10, defines a transformer or inductor 8.

Figure 2:
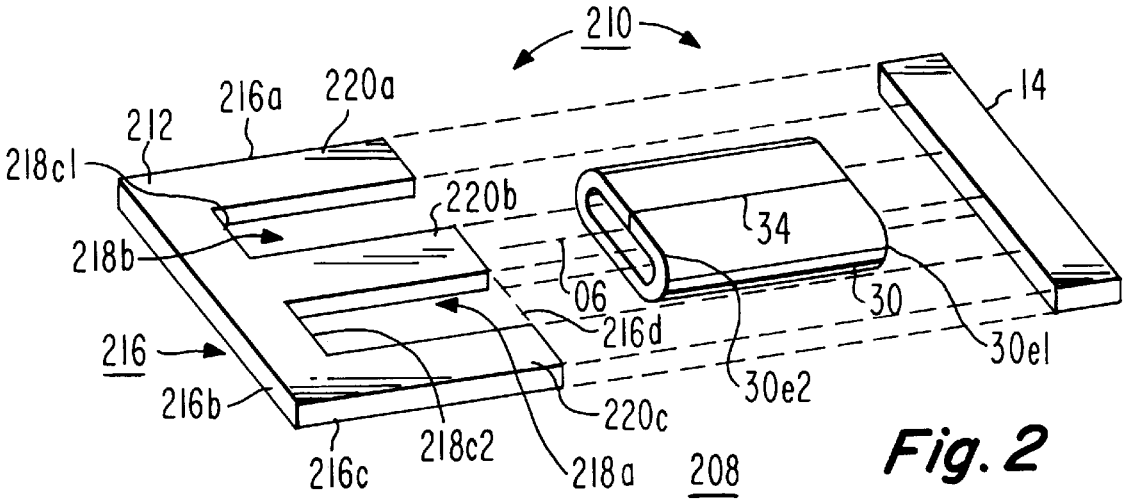
FIG. 2 is a simplified perspective or isometric, exploded view of a transformer or inductor with an E-I core according to an aspect of the invention.

The arrangement of FIG. 2 is similar to FIG. 1, and corresponding elements are designated by the same reference numerals, while similar elements are designated by like reference numerals in the 200 series. In FIG. 2, a magnetically permeable core 210 includes an E-portion 212 and an I-portion 14. E-portion 212 may be viewed as being a flat piece defining a peripheral edge 216 with portions 216*a*, 216*b*, 216*c*, and 216*d*, and notches 218*a* and 218*b* cut into the flat piece from edge 216*d* to thereby divide the flat piece into two elongated, mutually parallel outer legs 220*a* and 220*c*, and a central leg 220*b*, joined at the closed ends 218*c*1 and 218*c*2 of slots 218*a* and 218*b*, respectively. The I piece 14 of core 210 is dimensioned to fit across the ends of legs 220*a*, 220*b*, and 220*c*, and, when assembled, to be coplanar with the flat U portion 212 of the core. FIG. 2 also illustrates flat tube 30, with its aperture 32. The dimensions of tube 30 are selected such that the tube aperture 32 fits over leg 20*b*, and its length is no greater than the length of leg 20*b*, so that the I portion 14 of the core 10 can be juxtaposed with the ends of the legs 20*a*, 20*b*, and 20*c* when the tube is in place on leg 20*b*. As in the case of FIG. 1, tube 30 carries the windings which, in conjunction with core 210, defines a transformer or inductor 208.

Figure 3:
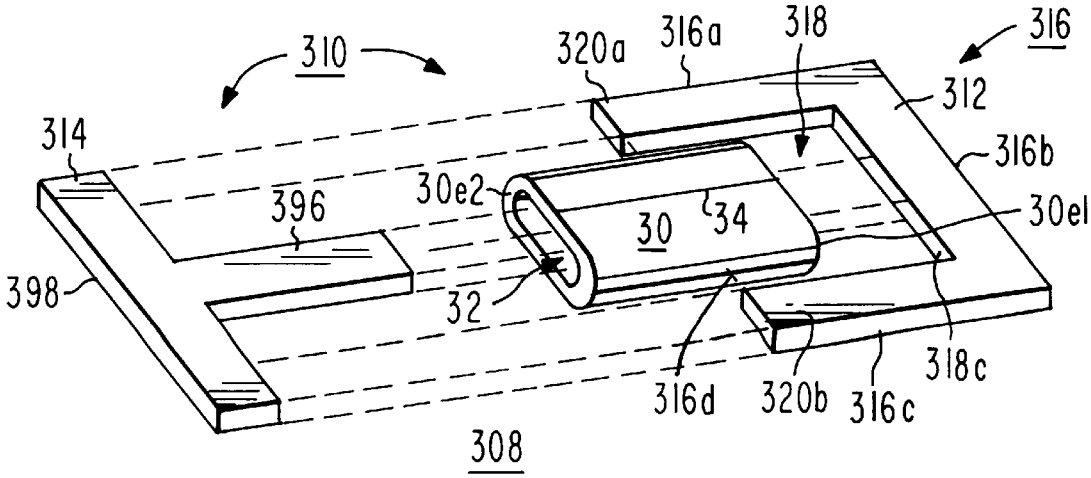
FIG. 3 is a simplified perspective or isometric, exploded view of a transformer or inductor with a U-I core according to an aspect of the invention.

The arrangement of FIG. 3 is similar to FIG. 1, and corresponding elements are designated by the same reference numerals, while similar elements are designated by like reference numerals in the 300 series. In FIG. 3, a magnetically permeable core 310 includes a T-portion 314 and a U-portion 312. U-portion 312 may be viewed as being a flat piece defining a peripheral edge 316 with portions 316*a*, 316*b*, 316*c*, and 316*d*, and a notch 318 cut into the flat piece from edge 316*d* to thereby divide the flat piece into two elongated, mutually parallel outer legs 320*a* and 320*b*, joined at the closed end 318*c* of slots 318. The cross section 398 of T piece 314 of core 310 is dimensioned to fit across the ends of legs 320*a* and 320*b*, and, when assembled, to be coplanar with the flat U portion 312 of the core. FIG. 2 also illustrates flat tube 30, with its aperture 32. The dimensions of tube 30 are selected such that the tube aperture 32 fits over the upright 396 of T section 314, and its length is no greater than the length of leg 396, so that the upright 396 of T portion 314 of the core 310 can be juxtaposed with the ends of the legs 320*a* and 320*b* when the tube is in place on leg 396. As in the case of FIG. 1, tube 30 carries the windings which, in conjunction with core 310, defines a transformer or inductor 308.

Figure 4A:
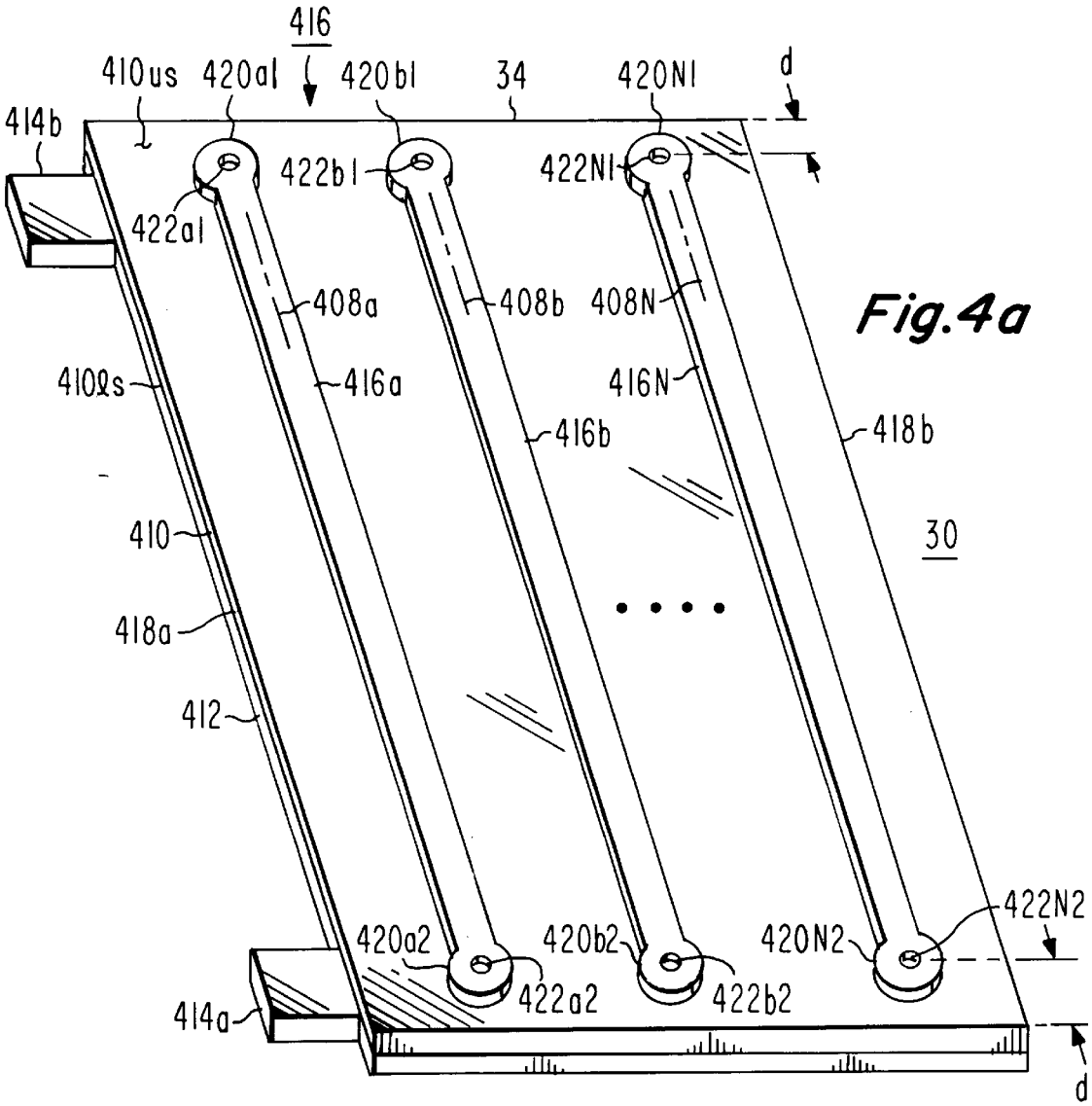
FIG. 4*a* is a simplified perspective or isometric view of an unrolled winding tube according to an aspect of the invention, in which the turns of primary winding have their respective ends overlapping and the secondary winding is on the outside of the tube.

FIG. 4*a* represents tube 30 of FIGS. 1, 2, or 3, opened at parting line 34, and flattened or developed to illustrate certain details. In FIG. 4*a*, tube 30 includes a layer of dielectric material 410, including an upper or first broad side or surface 410*us*, and also defining a second or lower broad side or surface 410*ls*, which is seen only as an edge in FIG. 4*a*. The lower surface 410*ls* is attached to or supports a layer 412 of electrically conductive metal. A pair of electrically conductive tabs 414*a* and 414*b* are in electrical contact with conductive layer 412, to provide a pair of terminals by which electrical connections may be made to sheet 412.

The upper surface 410*us* of dielectric sheet 410 bears a pattern including a set 416 of elongated electrically conductive strips 416*a*, 416*b*, . . . 416N, each of which defines an axis of elongation 408*a*, 408*b*, . . . 408N, laid out with their axes of elongation mutually parallel. As illustrated in FIG. 4*a*, the axes of elongation are parallel with sides 418*a* and 418*b* of the dielectric sheet 410. The ends of the elongated conductors of set 416 do not reach the parting line 34 along which the tube 30 was illustrated as being opened. Instead, each conductor strip 416*a*, 416*b*, . . . 416N of set 416 terminates at a distance designated as d from the parting line 34. The terminations, for clarity, are illustrated as enlarged portions or terminals of the strips. The enlarged portions associated with elongated conductive strip 416*a* are designated 420*a*1 and 420*a*2, the enlarged portions associated with elongated conductive strip 416*b* are designated 420*b*1 and 420*b*2, and the enlarged portions associated with elongated conductive strip 416N are designated 420N1 and 420N2. Through vias are located in the end portions of elongated conductive strips 416*a*, 416*b*, . . . 416N. More particularly, through vias in the form of plated-through apertures 422*a*1 and 422*a*2 are located in end portions 420*a*1 and 420*a*2, respectively. Similarly, through vias in the form of plated-through apertures 422*b*1 and 422*b*2 are located in end portions 420*b*1 and 42O*b*2, respectively, and corresponding vias and apertures 422N1 and 422N2 are located in end portions 420N1 and 420N2, respectively.

Figure 4B:
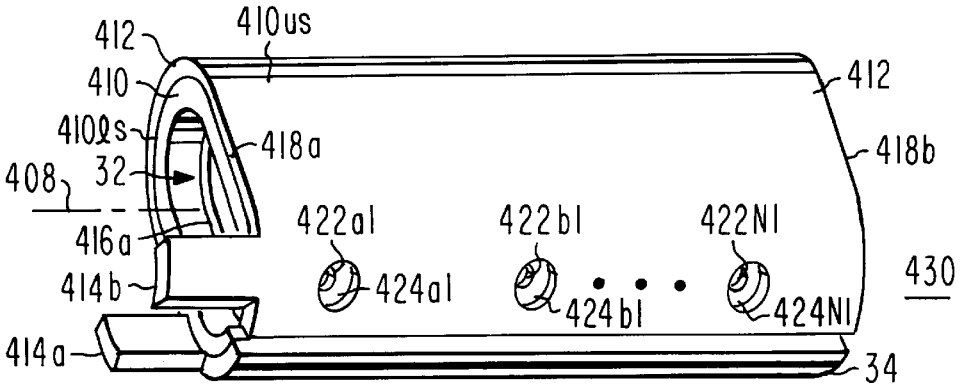
FIG. 4*b* is a simplified view of the formed or wound tube according to an aspect of the invention.

FIG. 4*b* illustrates the result of physically rolling the structure of FIG. 4*a* into a tube, which is designated 430, with parting lines 34 juxtaposed, and with elongated conductor strips of set 416 on the inside surface of the tube. This view allows the reverse sides of through via apertures 422*a*1, 422*b*1, and 422N1 to be seen, relative to FIG. 4*a*. As illustrated, the electrically conductive sheet 412 is cut away in a region 424*a*1, 424*a*1, and 424*a*1 around through via apertures 422*a*1, 422*b*1, and 422N1, respectively, which prevents electrical contact between the electrically conductive strips of set 416 of strips and conductive sheet 412, at least by way of the conductive vias.

Figure 4C:
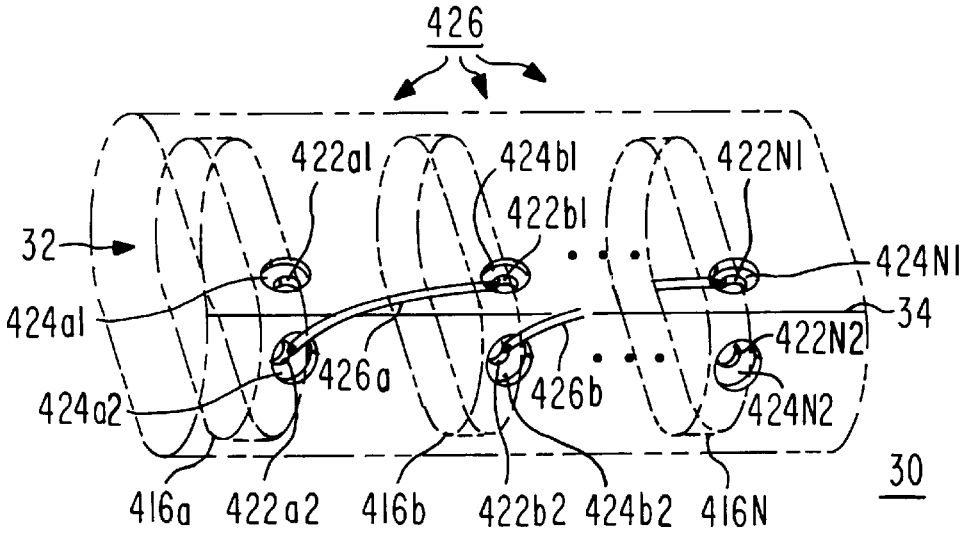
FIG. 4*c* represents another view of the tube 430 of FIG. 4*b*, with certain portions in phantom, to illustrate interconnections which form multiturn windings.

FIG. 4*c* represents another view of the tube 430 of FIG. 4*b*, with certain portions in phantom, to illustrate interconnections which form multiturn windings from the elongated strip conductors of set 416.

In FIG. 4*c*, electrical conductor strip 416*a* extends from electrically conductive via 422*a*1 to electrically conductive via 422*a*2. Similarly, electrical conductor strip 416*b* extends from electrically conductive via 422*b*1 to electrically conductive via 422*b*2, and electrical conductor strip 416N extends from electrically conductive via 422N1 to electrically conductive via 422N2. A first electrical interconnection 426*a* of a set 426 of electrical interconnections is connected to via 422*a*2 and to via 422*b*1. This electrical connection provides two turns about the central aperture 32, which corresponds to two turns about a magnetic core when the structure is fully assembled. The current path in these first two turns extends from through via 422*a*1 through strip 416*a* to via 422*a*2, through interconnection 426*a* to via 422*b*1, and through strip conductor 416*b* to via 422*b*2. Those skilled in the art recognize that two complete turns are defined with the described connections and with ordinary external connections. Additional turns may be added by concatenating the connections, as for example by connecting an additional electrical interconnection 426*b* between through via 422*b*2 and the through via of the next adjacent (or non-adjacent, if desired) strip conductor. Thus, in principle, connection 426*b* could extend from through via 422*b*2 to through via 422N1 of conductor strip 416N, so as to implicate conductive strip 416N as a turn of winding with strip conductors 416*a* and 416*b*.

Figure 4D:
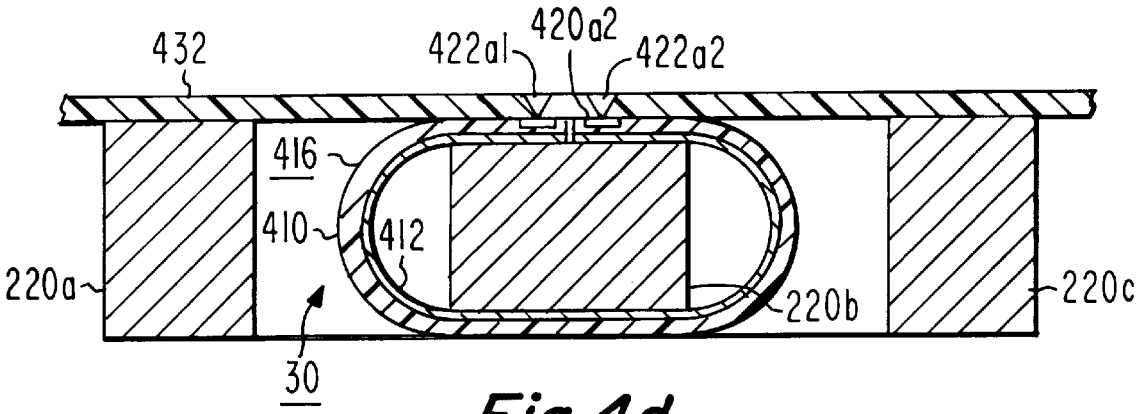
FIG. 4*d* represents a cross-sectional side elevation view of a transformer including an EI core with a tube corresponding to that of FIG. 4*c* extending over the center leg of the E section.
Figure 4E:
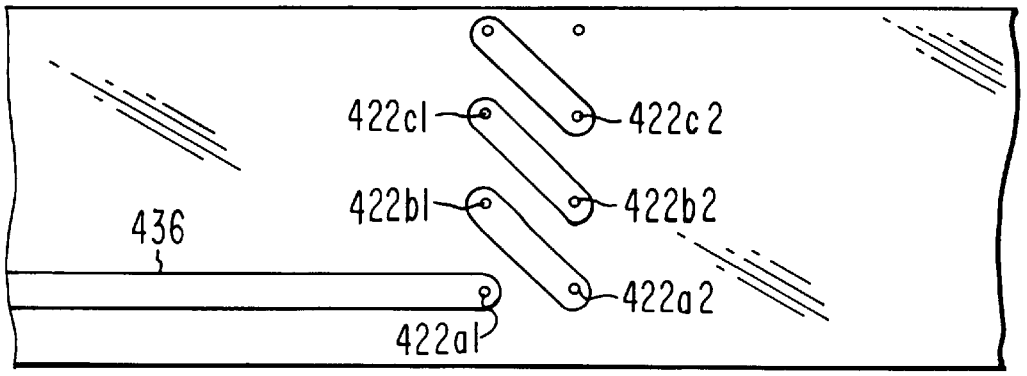
FIG. 4*e* is a plan view of a portion of the structure of FIG. 4*d*, illustrating "printed" electrical interconnections.

FIG. 4*d* represents a cross-sectional side elevation view of a transformer including an EI core with a tube corresponding to that of FIG. 4*c* extending over the center leg of the E section. As illustrated in FIG. 4*d*, the height of central leg 220*b* is reduced by machining, so that legs 220*a* and 220*c* are higher. The amount of the reduction in height or thickness of the center leg is by the twice the thickness of the tube dielectric material 410 (and any thickness of the associated electrically conductive layers attached thereto), plus the thickness of an HDI substrate 432. FIG. 4*e* is a plan view of a portion of the structure of FIG. 4*d*, illustrating the "printed" electrical interconnections 434*a*, 434*b*, 434*c*, . . . carried by the upper surface of HDI substrate 432, which provide paths between the through via sets 422*a*2, 422*b*1: 422*b*2, 422*c*1: 422*c*2, . . . to connect the various elongated conductors of set 416 into a serial winding. The plan view of FIG. 4*e* also illustrates another electrical conductor path 436, which represents a connection from a circuit external to the transformer to the end of the serial winding at through via 422*a*1. A similar electrical conductor (not illustrated) makes a corresponding connection to the other end of the serial winding so formed. While the HDI layer 432 of FIG. 4*d* has been illustrated as being a single layer akin to an ordinary flexible printed circuit, it may of course be a multilayer device, and the illustrated electrical paths may be in any one of the layers, or distributed among many layers.

Figure 5A:
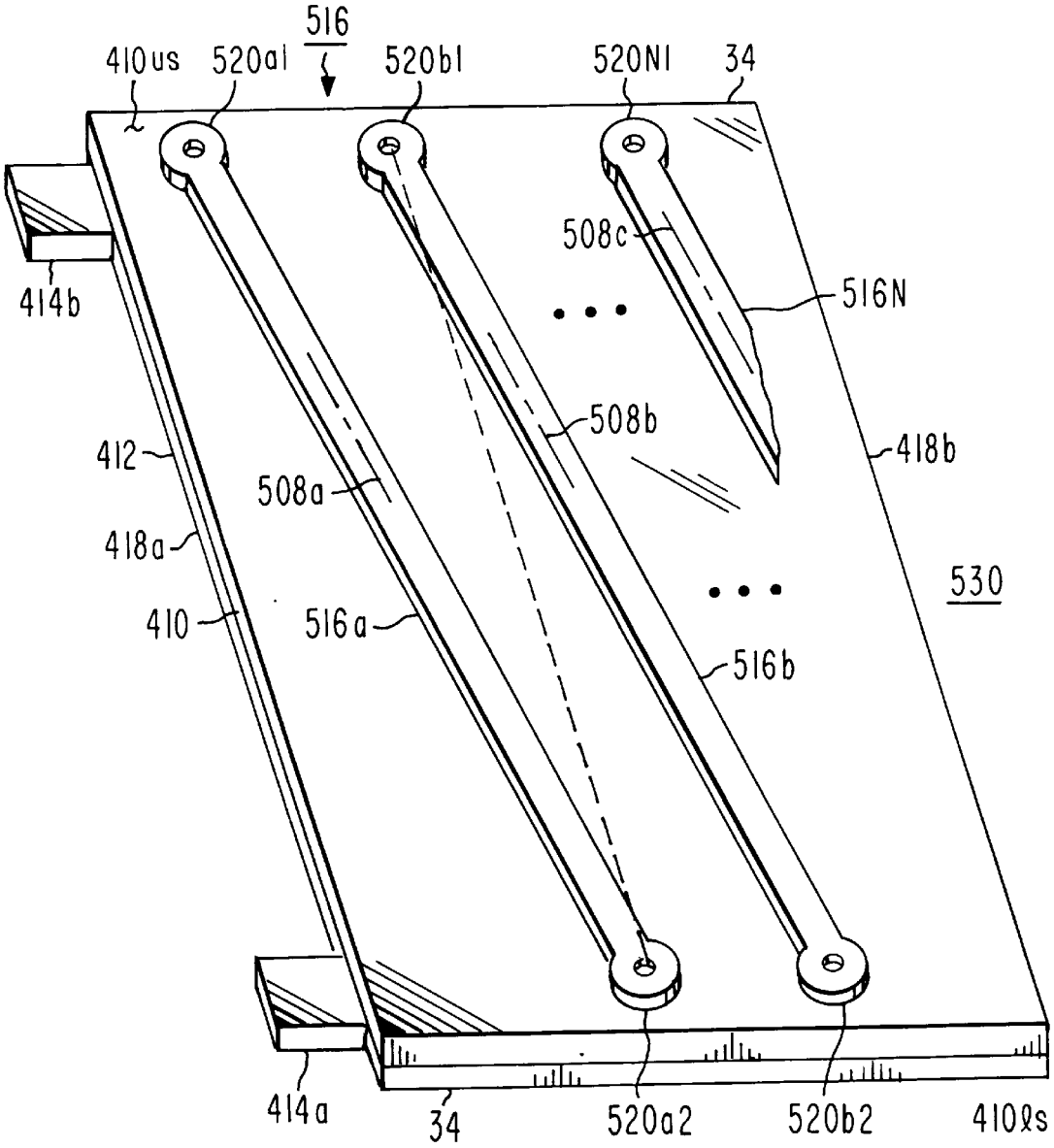
FIG. 5*a* is a simplified perspective or isometric view of an unrolled winding according to another aspect of the invention, in which the turns of primary winding have ends which overlap the ends of adjacent turns of primary winding, for connection by way of a simple via, and in which the primary winding is on the inside of the tube.

FIG. 5*a* illustrates another arrangement 530 generally similar to structure 30 of FIG. 4*a*, but in which the electrically conductive strips or strip conductors are somewhat skewed, so that the through via of one conductive strip overlies a through via of another conductive strip. This arrangement allows the use of high-density-interconnect-type (HDI-type) interconnections to make the desired multiturn windings. The fabrication of such interconnections may include the steps of juxtaposing the end portions of the strips one over the other, laser drilling the via aperture through at least the dielectric from one end portion to the other, and plating the through aperture to create the conductive via. Elements of FIG. 5*a* corresponding to those of FIG.

4*a* are designated by like reference numerals. Thus, dielectric substrate 410 includes an upper surface 410*us* and a lower surface 410*ls*. A layer 412 of electrically conductive material is affixed to the lower surface 410*ls*, and it is electrically connected to protruding tabs 414*a* and 414*b*, located at respective ends of the structure 530. In FIG. 5*a*, the strip conductors are designated by the same reference numerals as in FIG. 4*a*, but in the 500 series, to thereby emphasize the difference in the layout. In FIG. 5*a*, strip conductor 516*a* extends from a first end portion 520*a*1 to a second end portion 520*a*2. Similarly, strip conductor 516*b* extends from a first end portion 520*b*1 to a second end portion 520*b*2. Only a portion of the $N^{th}$ strip conductor 516N is shown, which is connected at the first end to end portion 520N1. The pitch of the windings is selected so that, when the structure 530 is rolled into a tube, the second end portions of the strip conductors overlie the first end portions of the strip conductors. Thus, when the structure 530 of FIG. 5*a* is rolled into a tube by juxtaposing its edges 34, end portion 520*b*1 overlies end portion 520*a*2 (or vice versa). It makes no difference which one overlaps the other, as the basic purpose is to allow direct interconnection between the 520×2 terminal or region of the $x^{th}$ strip conductor and the 520(×+1)1 terminal or region of the $(\times+1)^{th}$ strip conductor. With the defined overlap, the juxtaposed end regions are laser (or otherwise) drilled to define a through aperture, and the aperture is plated-through to make the desired connections. Those skilled in the art know that, in order to take up tolerances in the overlapping and drilling, it is desirable to have a small conductive region centered at the location at which the drilled hole is expected to appear, to which the through plating may make contact.

Figure 5B:
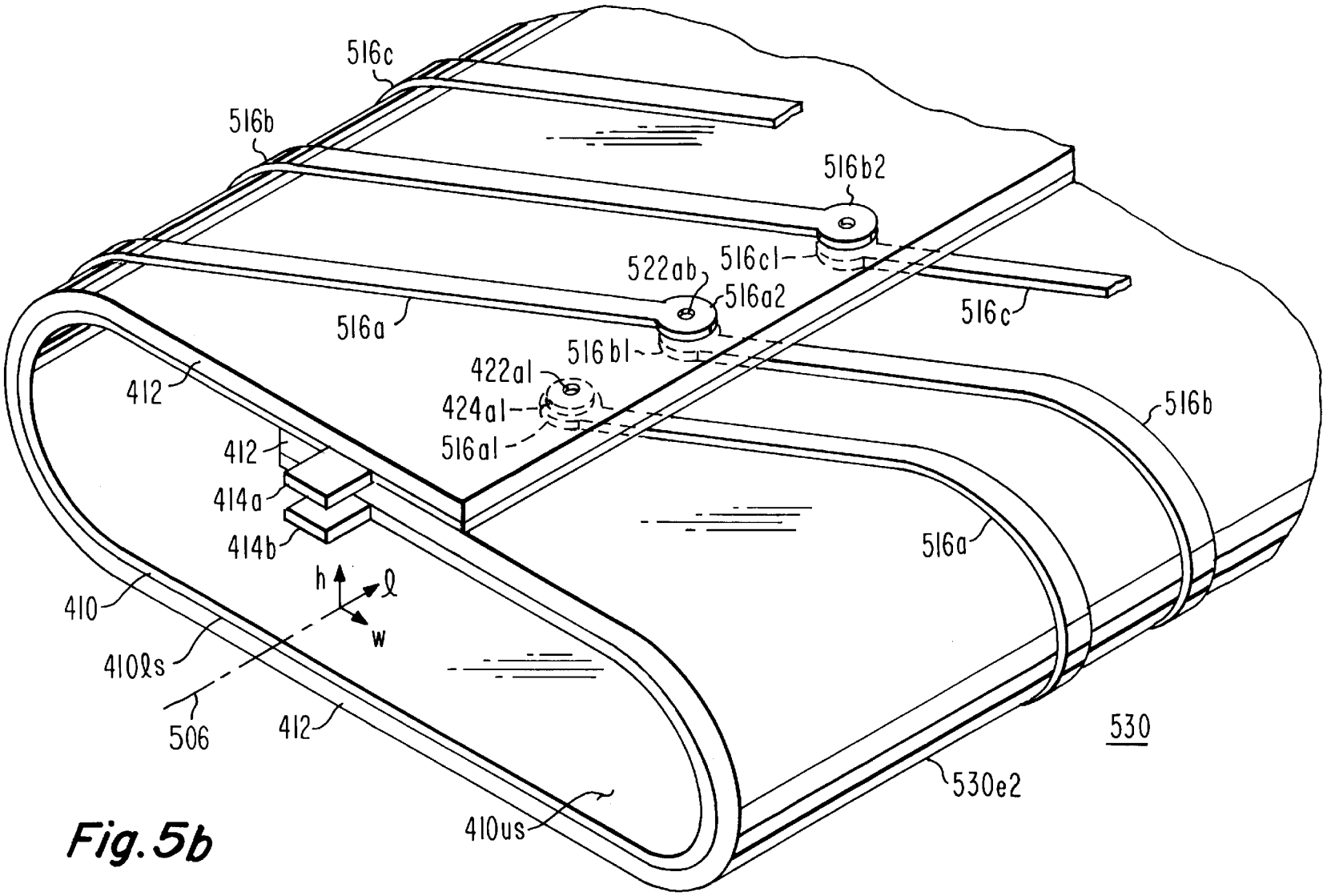
FIG. 5*b* is a simplified perspective or isometric view of the winding of FIG. 5*a* formed into a flat tube.

FIG. 5*b* represents the structure of FIG. 5*a* rolled into a tube. Elements of FIG. 5*b* corresponding to those of FIG. 5*a* are designated by like reference numerals. In FIG. 5*b*, the structure of FIG. 5*a* has been rolled with the upper surface 410*us* as the outer surface of the tube, and so the multiple turns are on the outside of the tube, rather than on the inside as in FIGS. 4*b* and 4*c*. In FIG. 5*b*, end portion 516*a*1 of strip conductor 515*a* extends under the overlapping edge of the dielectric 410 and sheet conductor 412, and so is seen in phantom. Also in phantom is the clear region 424*a*1 in the sheet conductor 410, surrounding end region 516*a*1 to prevent electrical contact between the sheet and strip conductors. The plated-through via associated with end region 516*a*1 is 422*a*1, and 522*a*1 is a plated region surrounding via 422*a*1. Plated-through via 422*a*1 represents the beginning of the multiturn winding formed by interconnected strip conductors 516*a*, 516*b*, and 516*c* of FIG. 4*b*.

In FIG. 5*b*, strip conductor 516*a* extends around the outer surface 410*us* of dielectric 410 from via 422*a*1 to a via 522*ab*. Via 522*ab* extends through the dielectric material 410 from end portion 516*a*2 of strip conductor 516*a* to make electrical contact with end portion 516*b*1 of strip conductor 516*b*. Strip conductor 516*b* extends around the outer surface 410*us* of the dielectric 410 to an end region 516*b*2. End region 516*b*2 overlies the end region 516*c*1 of a strip conductor 516*c*. Strip conductor 516*c* extends around the outer surface 410*us* of the tube to another end portion (not illustrated). The concatenation of such connections makes a multiturn winding which may be used as a primary winding of a voltage step-down transformer, or as the secondary winding of a voltage step-up transformer.

Figure 6:
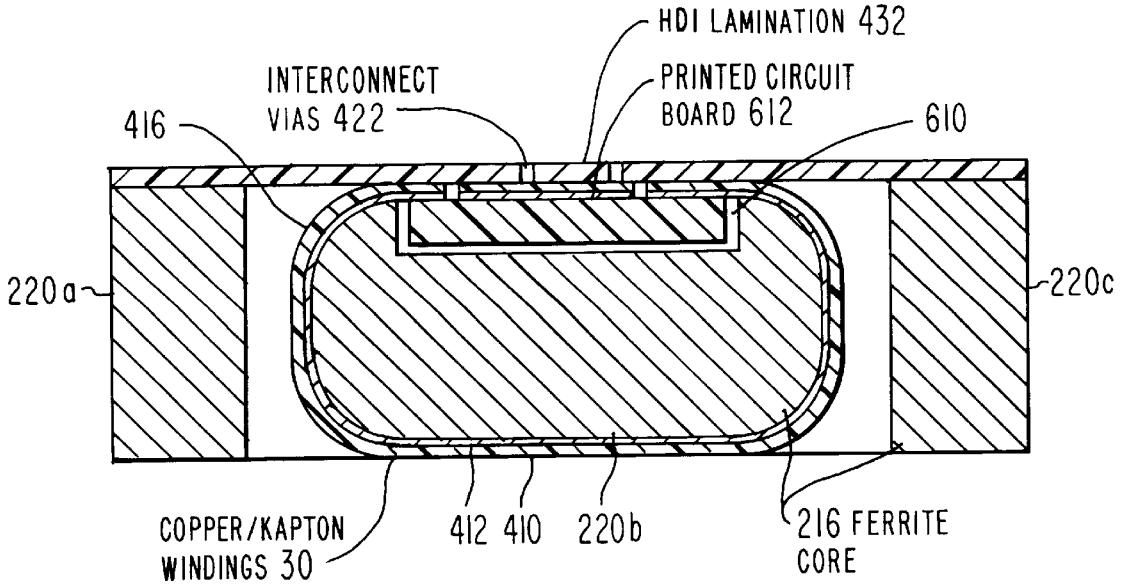
FIG. 6 is a simplified cross-sectional view of an embodiment of the invention using an EI core and a tube winding arrangement similar to that of FIG. 4*b* or 5*b;*

FIG. 6 is a simplified cross-sectional view of an embodiment of the invention using an EI core and a tube winding arrangement similar to that of FIG. 4*b* or 5*b*. In FIG. 6, elements corresponding to those of FIG. 4*d* are designated by the same reference numerals. The arrangement of FIG. 6 has a depressed portion 610 of the center leg 220*b* of the ferrite core 216 formed therein, as by machining. The depression 610 accommodates a printed-circuit board 612, which facilitates pre-assembly of the structure prior to sliding the tube onto the core, can be used to provide some of the interconnection paths, and provides some mechanical stability. The dimensions of the tube and the core are such that connections may be made to the tube conductors by HDI vias 442.

Figure 7A:
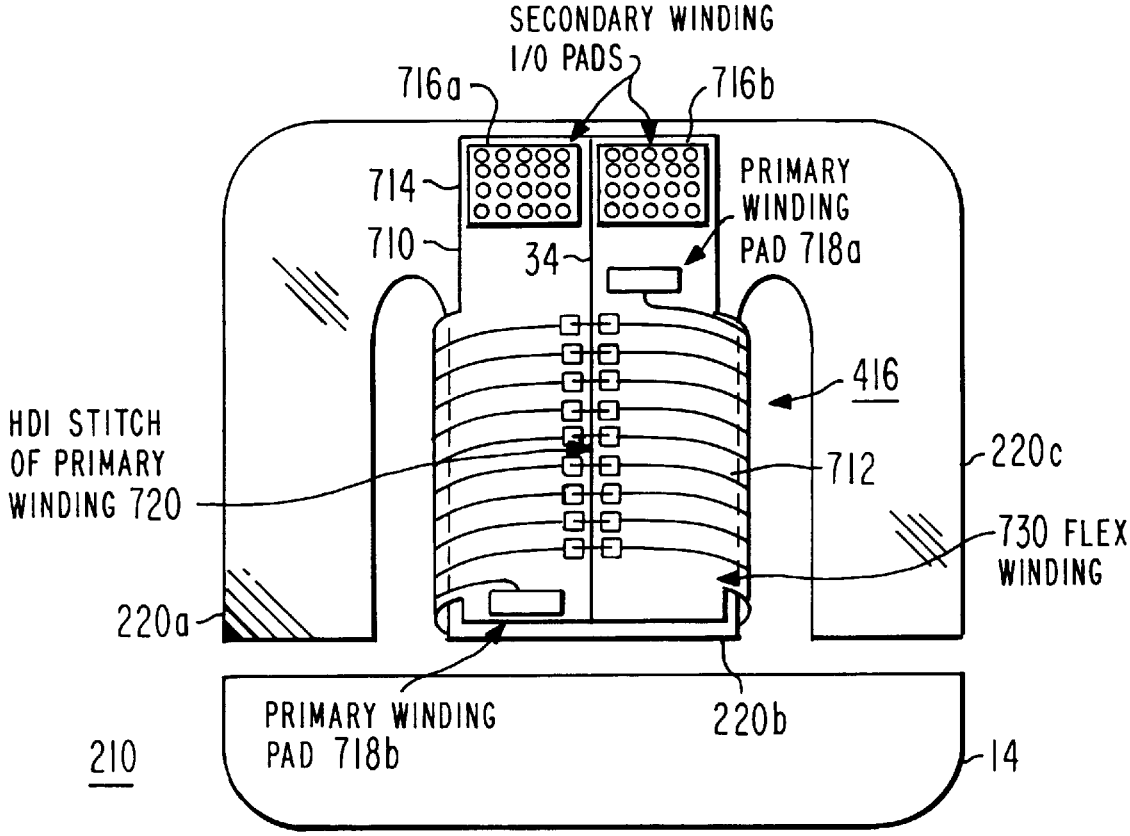
FIG. 7*a* represents a transformer according to an aspect of the invention in which the tube or flex winding is mounted over the center leg of an EI core.
Figure 7B:
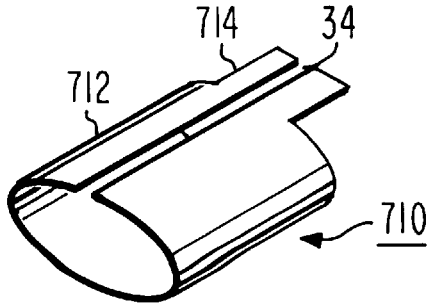
FIG. 7*b* is a perspective or isometric view of the tube of FIG. 7*a;*

FIG. 7*a* represents a transformer according to an aspect of the invention in which the tube or flex winding 730 is mounted over the center leg 220*b* of an EI core 210. In this particular transformer, the multiturn winding is the primary winding. The substrate upon which the elongated conductors of set 416 of conductors are defined or deposited is designated 710. The ends of the elongated electrical conductors of the set 416 of conductors are not superposed, but rather lie on either side of the parting line 34. Reference to FIG. 7*b* shows that the substrate 710 includes a portion 712 which is wound into a tube, and an additional portion 714 which is left substantially flat. As illustrated in FIG. 7*a*, flat portion 714 of substrate 710 bears two large secondary winding pads 716*a* and 716*b*. Each of pads 716*a* and 716*b* contains a pattern of multiple vias or through connections which make contact with the one- (or possibly two-) turn electrically conductive layer on the inside of the tube. The multiple vias, and the large land size of pads 716*a* and 716*b*, is to accommodate the relatively large current which can be expected in the secondary winding in this sort of transformer. FIG. 7*a* also illustrates HDI stitch of the primary winding electrical conductors by way of short electrical conductors, one of which is designated 720. Stitch 720 extends from one end of a conductor to the other end of the next conductor, as described in more detail in conjunction with FIG. 4*c*. The stitches are not part of, or on, substrate 710, but are instead on an HDI substrate (not illustrated in FIG. 7*a*) which overlies the substrate 710, much as HDI substrate 432 of FIG. 4*d* overlies winding-conductor-carrying substrate 410. The HDI substrate (not illustrated) overlying substrate 710 in FIG. 7*a* provides stitch-like interconnection of the otherwise-separate conductors of set 416 of conductors, in order to define the multiturn primary winding, and also provides connections between (a) the primary winding input-output pads 718*a* and 718*b* and circuits external to the transformer of FIG. 7*a*, and (b) the secondary winding pads, 716*a* and 716*b*, and circuits external to the transformer.

Figure 8A:
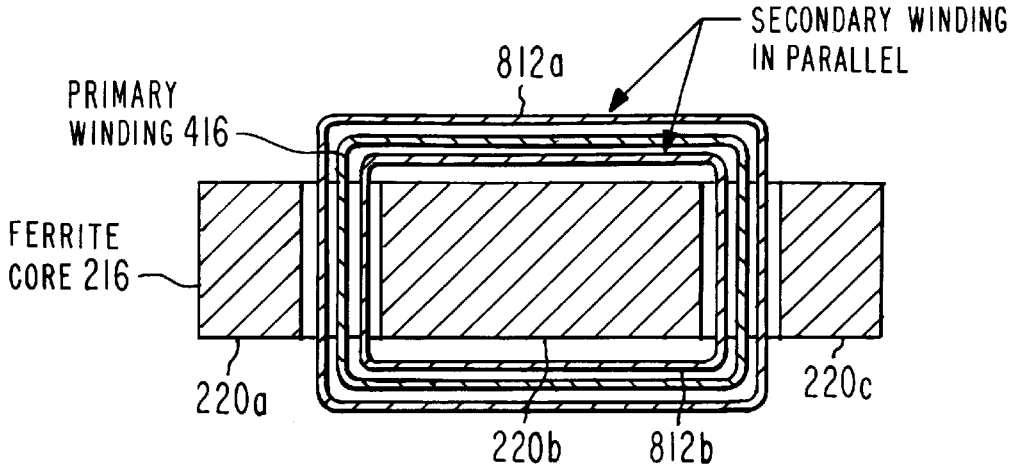
FIG. 8*a* is a simplified cross-sectional representation of a transformer according to an aspect of the invention in which the secondary winding includes two turns, and in which the primary winding tube is physically located between the two turns.
Figure 8B:
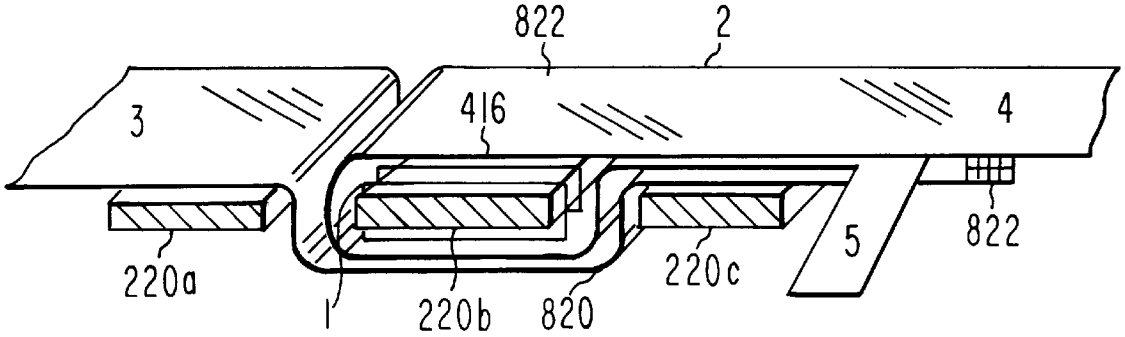
FIG. 8*b* shows how two single-turn secondary windings can be wound about a magnetically permeable core.
Figure 8C:
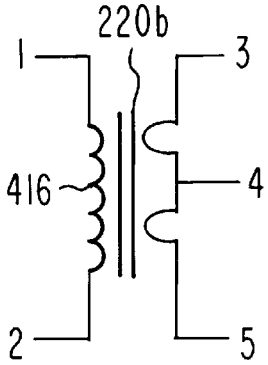
FIG. 8*c* is a schematic representation of the structure of FIG. 8*b*.

FIG. 8*a* is a simplified cross-sectional representation of a transformer according to an aspect of the invention in which the secondary winding includes two turns, and in which the primary winding tube is physically located between the two turns of the secondary winding in order to reduce leakage of magnetic flux. In FIG. 8*a*, the EI core is designated 216, the center leg is designated 220*b*, and the two outer legs are designated 220*a* and 220*c*. The complete (with stitches or other connections to form a continuous path) primary winding is designated 416, As illustrated in FIG. 8*a*, there are two secondary windings, which are designated 812*a* and 812*b*. As illustrated in the cross-sectional view, secondary winding 812*a* surrounds the primary winding 416, and secondary winding 812*b* is surrounded by the primary winding 416. Another way of looking at the structure is to say that the primary winding lies between the two secondary windings. FIG. 8*b* shows how two single-turn secondary windings can be wound about a magnetically permeable core. While FIG. 8*b* illustrates all three legs 220*a*, 220*b*, and 220*c* of the EI core of FIG. 8*a*, those skilled in the art will recognize that the windings are made only around the center leg, and that the other two legs are therefore extraneous. In FIG. 8*b*, the multiturn primary winding 416 the like-designated portion of the symbolic transformer of FIG. 8*c*. A broad or sheet-like secondary winding conductor extends from terminal 3, down under leg 220*b* in a loop portion 820, and up and to the right to make contact with terminal 4 at a junction 822 and to define a first turn of the secondary winding. The second turn of the secondary winding is represented by that portion of broad sheet conductor 822 extending from terminal 4 to the left in FIG. 8*b*, downward around core 220*b*, and then to the right to terminal 5. It should be noted that those skilled in the art will recognize that the portion of broad conductor extending from terminal 3 to terminal 4 in loop 820 is not a "half" loop, because in magnetics there are only loops or no magnetic influence. Instead, there are only complete loops, which may have an appearance such as that of loop 820.

Figure 8D:
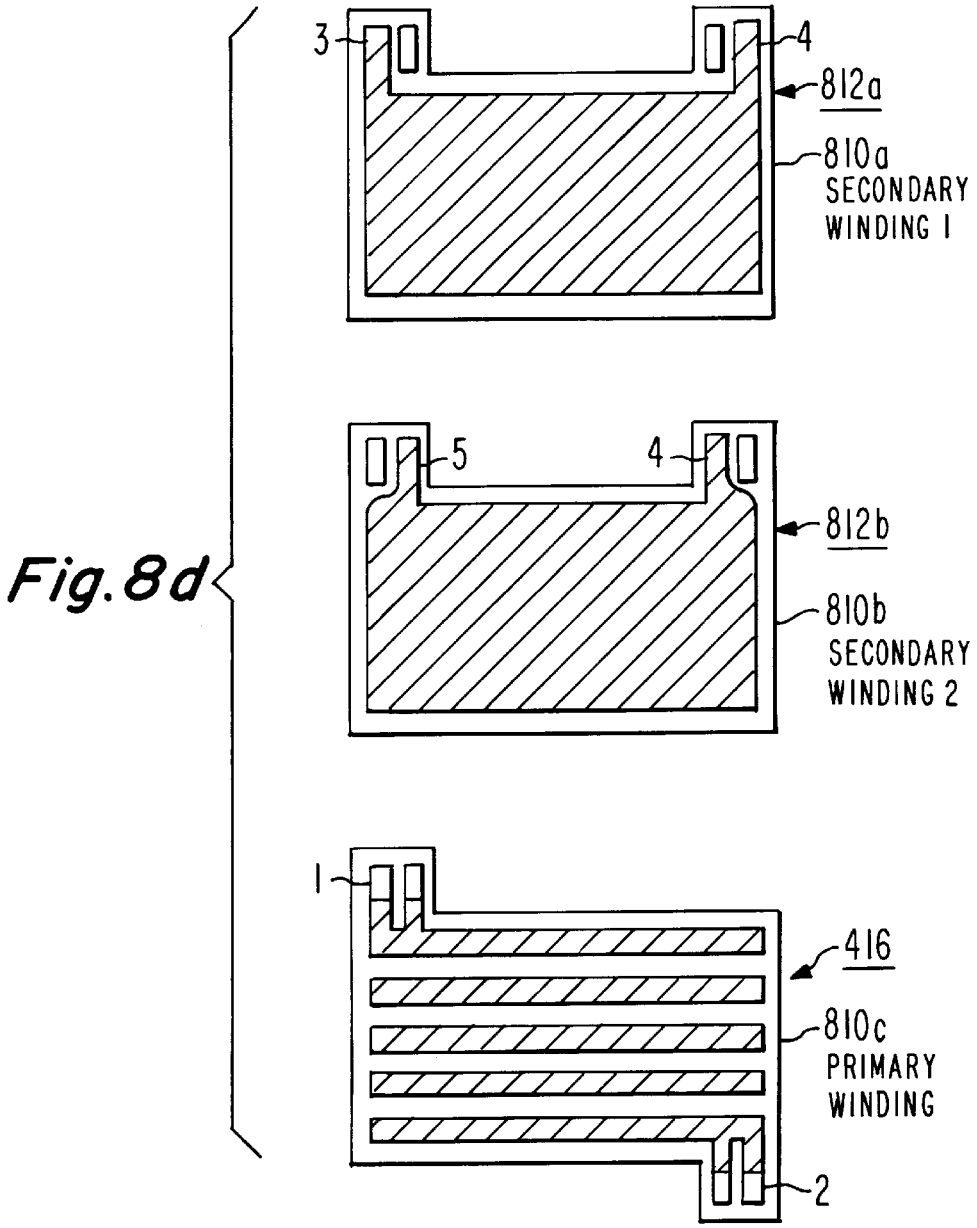
FIG. 8*d* is a plan view of the three windings of FIG. 8*a*.
Figure 8E:
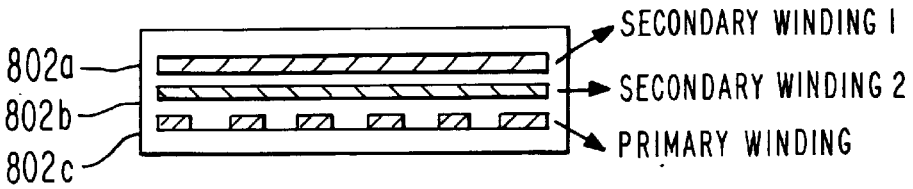
FIG. 8*e* is a cross-sectional view of the conductor pattern of the windings of FIG. 8*d* arranged in a pattern different from that illustrated in FIG. 8*a*.

In FIG. 8*d*, three windings similar to those of FIG. 8*a* are illustrated in plan view. Secondary windings 812*a* and 812*b* are defined on flexible dielectric sheets 810*a* and 810*b*, respectively. Winding 812*a* is associated with terminals 3 and 4, and winding 812*b* is associated with terminals 4 and 5. The multiturn primary winding 416 is defined on a sheet 810*c*, and is associated with terminals 1 and 2. FIG. 8*e* illustrates a cross-section of one possible way the sheets 810*a*, 810*b*, and 810*c* can be stacked to make a structure similar to that of FIG. 8*a*.

Figure 9:
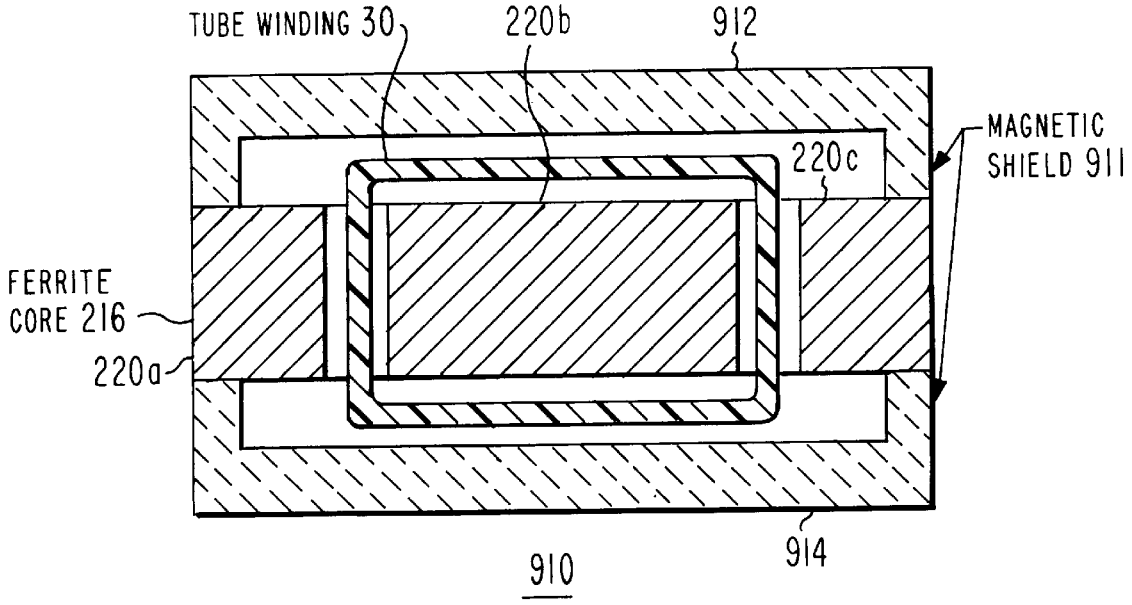
FIG. 9 is a simplified side elevation cross-sectional view of a transformer according to an aspect of the invention, in which an external magnetic shield is defined by a magnetically permeable shell.

FIG. 9 is a simplified side elevation cross-sectional view of a transformer 910 according to an aspect of the invention, in which an external magnetic shield 911 is defined by a magnetically permeable shell surrounding the core of a transformer. As illustrated, shield 911 is in the form of two half-shells 912, 914, which but against portions of legs 220*a* and 220*c* to form a closed magnetically permeable path surrounding center leg 220*b* and the tube winding 30. The magnetic shield 911 provides electromagnetic interference (EMI) shielding to prevent or ameliorate unwanted interaction between the transformer and external fields.

Figure 10B:
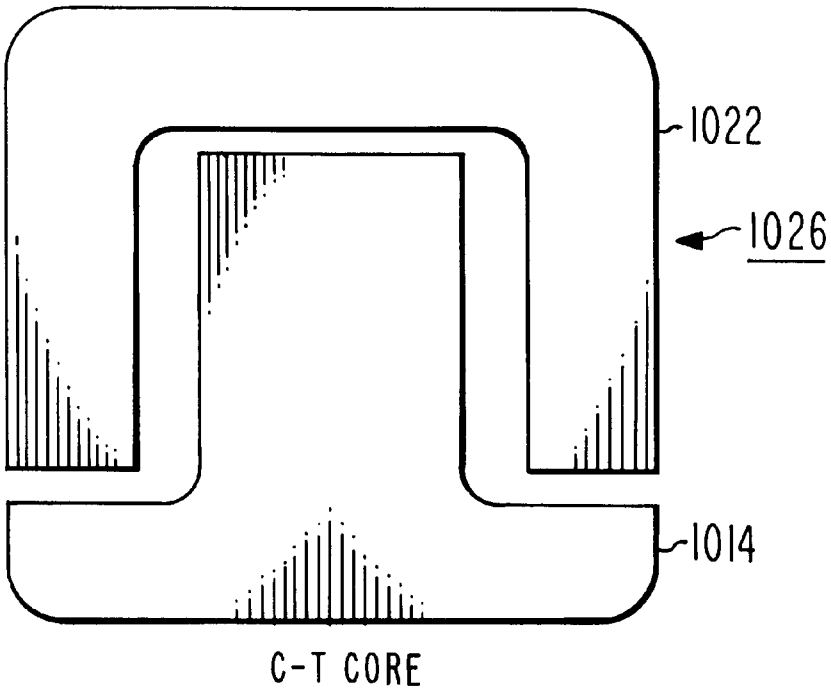
FIGS. 10*a*, 10*b*, and 10*c* are plan views of various cores which may be used in transformer or inductors according to the invention.
Figure 10A:
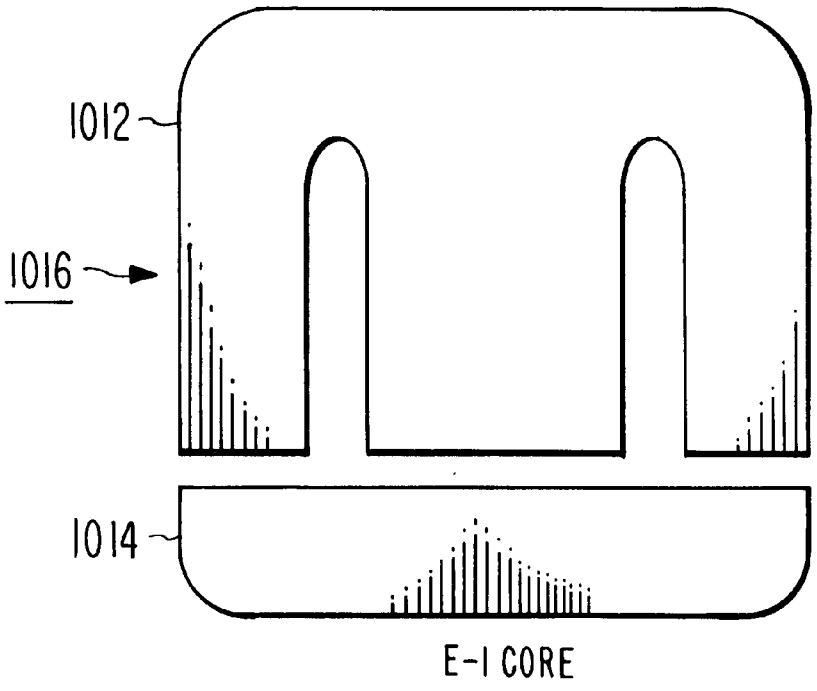

FIG. 10*a* is a plan or outline view of an EI core which may be used in transformer or inductors according to the invention, and FIG. 10*b* is a similar plan view of a CT core. In FIG. 10*a*, EI core 1016 includes an E section or portion 1012 and an I section or portion 1014. As illustrated in FIG. 10*a*, the EI core taken as a whole has a distributed air gap. The CT core of FIG. 10*b* helps to minimize the fringing flux, thereby reducing the eddy-current losses in the transformer or inductor by comparison with the EI core of FIG. 10*a*. Further, crowding of flux in the corners of the CT core tends to be minimized. In the cases of both cores 1016 of FIG. 10*a* and 1026 of FIG. 10*b*, the corners are rounded and not sharp in order to minimize flux concentrations in the core corners. This radiusing can be specified as a separate step, or can be inherent in the radii of the machining tools.

Figure 10C:
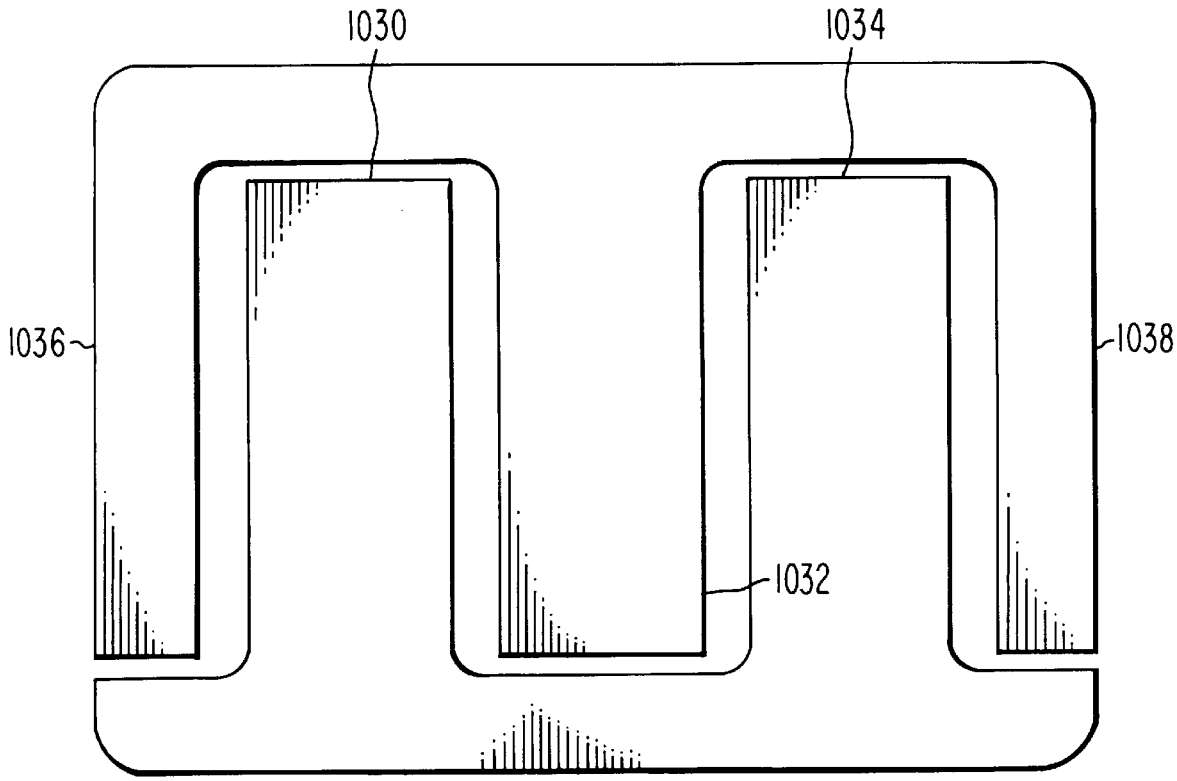

FIG. 10*c* illustrates a multipole core which may be used in a transformer or inductor according to the invention. The illustrated core includes three center legs 1030, 1032, and 1034, and two end legs 1036 and 1038. Each of the legs can be fitted with its own single- or multi-layer tube winding. This provides more volume in which magnetically coupled windings can be placed. This, in turn, helps to maximize "inductance/area" in low-profile inductor or transformer designs.

Figure 11:
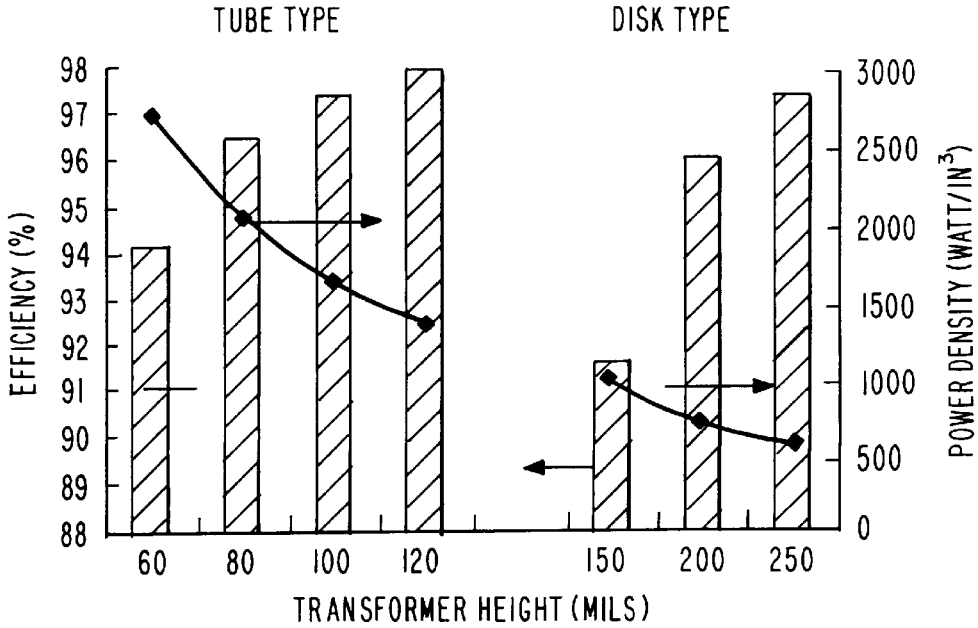
FIG. 11 is a chart which compares the power density versus height and efficiency versus height characteristics of two transformers.

FIG. 11 is a chart which compares the power density versus height and efficiency versus height characteristics of two transformers, one a tube-type transformer according to the invention, and the other a disk-type transformer. The particular transformers had a footprint of 0.32 square inches, and handled 50 watts at 1 MHz. As illustrated in the chart of FIG. 11, the disk-type transformer had an efficiency of about 91.5% at a height of 150 mils, an efficiency of about 96% at a height of 200 mils, and an efficiency of about 97% at 250 mils. By contrast, the tube-type transformer, even at a height of 60 mils, did not reach an efficiency below 94%, and achieved about 97% at a height of 120 mils. Clearly, from an efficiency point of view, the tube-type transformer is much superior to the disk-type transformer. The power density which can be achieved, measured in watts per cubic inch ($W/in^3$), is much higher for any height of the tube-type transformers, even though those heights are less than the least of the disk-type transformers. Put another way, the tube-type transformer can have more than twice the power density and less than half the profile of an equivalent disk-type transformer for operation in the stated frequency and power range.

A major advantage of tube-type magnetics such as those described herein is that the fractional volume of the core in the corners is small relative to the total volume of the core. This helps to minimize the increase in core loss attributable to flux crowding. This minimization of flux crowding core loss can be very important in the context of low-profile transformer or inductors, in which core losses can be as much as 30% higher than the losses calculated by using average flux density values.

A salient advantage of transformer or inductors having the described structure is that several different transformation ratios can be achieved using only one structure, by simply interconnecting so many of the strip conductors as together give the desired number of turns to interact with the other winding, represented by conductive sheet 412 and its connection tabs 414*a*, 414*b*.

The transformer or inductor according to the invention can be fabricated by metallizing the dielectric with the primary and secondary conductors, and then rolling the dielectric into a tube defining a parting line. The conductors are spaced on either side of the parting line. Through vias are extended through at least the dielectric substrate to make contacts which form or define complete multiturn windings. In one embodiment. In one embodiment, a further dielectric substrate overlies the parting line, and the through vias extend through, and make contact with, both conductors on the further substrate and on the substrate carrying the winding turns.

An advantage of transformer or inductors according to the invention is that the windings can all be formed on the dielectric sheet by photographic methods, thereby achieving great accuracy in dimensions and placement. This, in turn, allows the interelement capacitances and inductances to be maintained constant from unit to unit, with concomitant repeatability of performance.

Another advantage of a tube-type structure according to the invention is that additional windings can be added to the tube without increasing the profile height (in direction h of FIG. 5*b*) of the overall transformer or inductor, as would be the case when additional turns are added in a disk-type transformer or inductor. Instead, the additional turns may tend to make the tube longer (direction 1 of FIG. 5*b*), but it is the transverse dimension h of the tube which lies in the profile height direction of the transformer or inductor according to the invention. Thus, adding turns does not necessarily increase the profile height dimension of a power supply using a transformer or inductor according to the invention.

The desired structure includes plural winding segments, some of which can be stitched together to form continuous windings. Similarly, the multiturn and single-turn windings can be coupled in series to form an inductor rather than a transformer. Thus, the structure is more general than a transformer or inductor, and may be termed a magnetically coupled winding structure.

Other embodiments of the invention will be apparent to those skilled in the art. For example, the electrically conductive metal layer 412 of FIG. 4*a* may be, for example, a deposited layer of copper or other conductive metal, or it may be a copper (or other metal) foil or sheet to which the dielectric sheet 410 is affixed, as by adhesive. The layer may be of a nonmetallic material, so long as sufficiently conductive. While the end portions of the elongated strip conductors are illustrated and described in conjunction with FIG. 4*a* as being enlarged, such enlargement may not be necessary, depending upon the dimensions of the via holes and the tolerances in the fabrication. While a single-turn "secondary" winding 412 has been described, multiturn windings can be produced in much the same way as for the "primary" windings 416, 516. While the embodiments of FIGS. 4*b* and 4*c* provide clearance holes in the single-turn electrically conductive sheet 412 in the region underlying the ends, such as end 422*b*2, of the electrically conductive strips, such as strip 416*b*, the same effect could be achieved by simply stopping the electrically conductive sheet 412 at such a distance from the edges 34 as to clear the desired region.

Thus, a transformer or inductor (8, 208, 308) according to an aspect of the invention includes a flat, magnetically permeable core (10, 210, 310) including a flat first portion (12, 212, 312) defining first and second broad sides and at least one peripheral edge (16*d*, 216*d*, 316*d*). The flat, magnetically permeable core (10, 210, 310) also defines at least a first slot (18, 218*a*, 218*b*, 318) extending inward from the edge (16*d*, 216*d*, 316*d*), to thereby define a central core portion (20*b*, 220*b*) lying generally adjacent the first slot, and to also define at least a side core portion (16*b*, 216*b*) extending parallel with the central core portion (20*b*, 220*b*). The magnetically permeable core (10, 210, 310) further includes a flat, magnetically permeable end portion (14, 314) coplanar with the first portion (12, 212, 312) and magnetically coupled to the central core portion (20*b*, 220*b*) and to the first side core portion (20*a*, 220*a*) at a location adjacent the open end (remote from closed end 18*c*, 218*c*1, 218*c*2) of the slot (18, 218*a*, 218*b*). The transformer or inductor (8, 208, 308) also includes a dielectric sheet (410) defining first (410*us*) and second (410*ls*) broad, flat, mutually opposed sides. The dielectric sheet (410) includes a first electrically conductive layer (412) affixed to at least a substantial portion of the second side (410*ls*), and further includes a second layer (416) affixed to the first side (412*us*) of the dielectric sheet (410). The second layer (416) includes a plurality (sets 416, 516) of mutually isolated elongated second electrical conductors (416*a*, 416*b*, . . . , 416N; 516*a*, 516*b*, 516*c*, . . . 516N). Each of the plurality of mutually isolated elongated second electrical conductors (416*a*, 416*b*, . . . , 416N; 516*a*, 516*b*, 516*c*, . . . 516N) defines first (416*a*1, 416*b*1, . . . , 416N1; 516*a*1, 516*b*1, 516*c*1) and second (416*a*2, 416*b*2, . . . , 416N2; 516*a*2, 516*b*2, 516*c*2) ends, and an axis (506) of elongation extending between the first (30*e*1, 530*e*1) and second (30*e*2) ends. The axes (408*a*, 408*b*, . . . , 408N; 508*a*, 508*b*, 508*c*) of elongation of the second electrical conductors (416, 516) are generally parallel. The dielectric sheet (410) is generally curved to define a cylinder-like structure (30, 430). The dielectric sheet (410), so curved, defines a structure having the general shape of a flat tube having or defining first (30*e*1) and second (30*e*2, 530*e*2) ends, and having the first side (410*us*) of the dielectric sheet (410) on the inner side or inside of the flat tube (30, 530). The flat tube (30, 530) defines a central axis (6, 506), and is dimensioned to fit over the central core portion (20*b*, 220*b*), with the first end (30*e*2) of the tube (30, 530) adjacent the juncture of the central core portion (20*b*, 220*b*, 320*b*) with the side core portion (20*a*, 220*a*), and with the second end (30*e*1) of the tube (30, 530) adjacent the end portion (14) of the core (10, 210, 310). With such a curvature of the dielectric sheet (410), the first electrically conductive layer (410) is formed into an electrically open single turn about the central core portion. In this context, electrically open means that no current can flow in the single turn as a result of magnetic flux variation in the central core portion, because there is no complete path for the flow. The curvature of the dielectric sheet (410) also curves the elongated second conductors (sets 416, 516), so that each of the second electrical conductors defines an open single turn about the central core portion, with a first end of each of the elongated second electrical conductors generally adjacent to or contiguous with a second end thereof. The first and second ends of the second electrical conductors are substantially coplanar with one of the first and second broad sides of the magnetically permeable core (10, 210, 310) when the tube is fitted over the central portion of the core. The transformer or inductor (8, 208, 308) also includes a flexible interconnection sheet overlying the one of the first and second sides of the magnetically permeable core (10, 210, 310) and the first and second ends of the second elongated electrical conductors. The flexible interconnection sheet includes a layer of electrically conductive material defining at least interconnections between the first and second ends of the elongated second electrical conductors. These interconnections are defined in a manner which electrically interconnects at least the first end of one of the elongated second electrical conductors to the second end of a nearby one of the elongated second electrical conductors, to thereby define a single continuous electrical conductor wound in multiple turns about the central core portion. An electrically conductive arrangement is electrically coupled to mutually adjacent portions of the electrically conductive first layer, to thereby define electrical connection terminals for the single turn of electrical conductor about the first central core portion of the magnetically permeable core (10, 210, 310). These terminals may be in the form of projecting tabs, which preferably are located at one or the other ends of the tube.

In a particularly advantageous embodiment of the invention, the flat, magnetically permeable core (10, 210, 310) further defines at least a second slot extending inward from the edge, parallel with the first slot, to thereby define a second side portion lying generally adjacent the second slot. The second side portion lies parallel with the central core portion, and the flat, magnetically permeable end portion is coplanar with the central portion of the magnetically permeable core (10, 210, 310) and with the first and second side portions of the magnetically permeable core (10, 210, 310).

In one version of the transformer or inductor (8, 208, 308) according to the invention, the interconnections of the interconnection sheet are defined in a manner which electrically interconnects at least the first end of one of the elongated second electrical conductors to the second end of an adjacent one of the elongated second electrical conductors, to thereby define a single continuous electrical conductor wound in multiple turns about the central core portion.

A method according to the invention, for fabricating a transformer or inductor, includes the step of defining an electrically conductive primary winding conductor affixed to one broad side of a flat, flexible dielectric substrate. This step may include the affixing of a dielectric sheet to a metal sheet or foil, or may involve the deposition of electrically conductive material on a dielectric sheet. A plurality of electrically conductive regions are similarly defined on the other broad side of the dielectric substrate. Each of the electrically conductive regions is elongated in the direction of an axis of elongation, and the axes of elongation are at least about parallel. The dielectric substrate, together with its conductive regions, is rolled or formed into a tube or tube-like shape. The tube shape defines an interior aperture and a parting line, as a result of which, or whereby, the axes of the elongated regions are formed into curved figures. The tube in one embodiment of the invention is flattened or oval, so that the aperture is also flattened into a shape approximating the cross-section of a magnetic core with which it will ultimately be associated. The tube having an axis which is orthogonal to the plane of the curved figures defined by the axes of elongation of the elongated electrically conductive strips or regions. The elongated regions are electrically discontinuous along the parting line, because they are not yet interconnected. According to the method, the aperture of the tube is caused to surround a leg of a magnetically permeable core. This may be accomplished by winding, forming or forming the dielectric substrate (with its conductors) over a mandrel having dimensions similar to those of the leg of the core, over the core itself, or just rolling the substrate into a tube of about the right size, and inserting the core leg into the aperture in the tube. Naturally, either the core or the tube may be placed in relative motion, with the same inserting effect. Juxtaposed or adjacent ends of the various elongated regions are stitched together by creating through vias which interconnect ends of the elongated regions in a manner which forms at least some of the elongated regions into a continuous turn of winding about the leg. This last step may be accomplished by letting one edge of the tube at the parting line overlap the other, so that the ends of the conductive regions are registered, and forming through vias which interconnect the two ends. Alternatively, a separate interconnection sheet, which is preferably an HDI sheet, interconnects the ends of the strip conductor regions by means of separate conductive regions on the HDI sheet, using through vias to make the connections in question.

What is claimed is:

1. A magnetically coupled winding structure, comprising:

a flat, magnetically permeable core including a flat first portion defining first and second broad sides and at least one peripheral edge, and also defining mutually parallel first and second slots extending inward from said edge, to thereby define a central core portion lying generally between said first and second slots, and to also define first and second side core portions extending parallel with said central core portion, said magnetically permeable core further including a flat, magnetically permeable end portion coplanar with said first portion and magnetically coupled to said central core and to said first and second side core portions adjacent the ends of said slots;

a dielectric sheet defining first and second broad, flat, mutually opposed sides, said dielectric sheet including a first electrically conductive layer affixed to at least a substantial portion of said first side, and further including a second layer affixed to said second side of said dielectric sheet, said second layer including a plurality of elongated second electrical conductors, each of said plurality of elongated second electrical conductors defining first and second ends, and an axis of elongation extending between said first and second ends, with said axes of elongation of said second electrical conductors being mutually parallel, said dielectric sheet being curved in a generally cylindrical manner to thereby define a structure having the general shape of a flat tube defining first and second ends and having said first side of said dielectric sheet on the inner side of said flat tube, said flat tube defining a central axis, and being dimensioned to fit over said central core portion with said first end of said tube adjacent the juncture of said central core portion and said side core portions, and with said second end of said tube adjacent said end portion of said core, so that said first electrically conductive layer is formed into an electrically open single turn about said central core, and so that each of said second electrical conductors also defines an open single turn about said central core, with a first end of each of said elongated second electrical conductors adjacent a second end thereof, said first and second ends of said second electrical conductors being substantially coplanar with one of said first and second broad sides of said magnetically permeable core when said tube is fitted over said central portion of said core;

a flexible interconnection sheet overlying said one of said first and second sides of said magnetically permeable core and said first and second ends of said second elongated electrical conductors, said flexible interconnection sheet including a layer of electrically conductive material defining at least interconnections between said first and second ends of said elongated second electrical conductors, said interconnections being defined in a manner which electrically interconnects at least the first end of one of said elongated second electrical conductors to the second end of a nearby one of said elongated second electrical conductors, to thereby define a single continuous electrical conductor wound in multiple turns about said central core portion; and electrically conductive means coupled to mutually adjacent portions of said electrically conductive first layer, to thereby define a single turn of electrical conductor about said central core portion of said magnetically permeable core.

2. A magnetically coupled winding structure according to claim 1, wherein said interconnections of said interconnection sheet are defined in a manner which electrically interconnects at least the first end of one of said elongated second electrical conductors to the second end of an adjacent one of said elongated second electrical conductors, to thereby define a single continuous electrical conductor lying only on said second side of said dielectric sheet and on said interconnection sheet, and wound in multiple turns about said central core portion.

3. A structure according to claim 1, wherein said first electrically conductive layer affixed to at least a substantial portion of said first side of said dielectric sheet defines first and second projecting tabs, said projecting tabs of said first and second electrically conductive layer being such that, when said dielectric sheet forms said tube defining first and second ends, said projecting tabs are adjacent one of said first and second ends.

4. A structure according to claim 1, wherein said first electrically conductive layer affixed to at least a substantial portion of said first side of said dielectric sheet defines first and second projecting tabs, said projecting tabs of said first and second electrically conductive layer being such that, when said dielectric sheet forms said tube defining first and second ends, said projecting tabs are adjacent said first end of said tube.

5. A magnetically coupled winding structure, comprising:

a flat, magnetically permeable core including a flat first portion defining first and second broad sides and at least one peripheral edge, and also defining at least a first slot extending inward from said edge, to thereby define a central core portion lying generally adjacent said first slot, and to also define at least a side core portion extending parallel with said central core portion, said magnetically permeable core further including a flat, magnetically permeable end portion coplanar with said first portion and magnetically coupled to said central core portion and to said first side core portion adjacent the end of said slot;

a dielectric sheet defining first and second broad, flat, mutually opposed sides, said dielectric sheet including a first electrically conductive layer affixed to at least a substantial portion of said first side, and further including a second layer affixed to said second side of said dielectric sheet, said second layer including a plurality of elongated second electrical conductors, each of said plurality of elongated second electrical conductors defining first and second ends, and an axis of elongation extending between said first and second ends, with said axes of elongation of said second electrical conductors being mutually parallel, said dielectric sheet being curved in a generally cylindrical manner to thereby define a structure having the general shape of a flat tube defining first and second ends and having said first side of said dielectric sheet on the inner side of said flat tube, said flat tube defining a central axis, and being dimensioned to fit over said central core portion with said first end of said tube adjacent the juncture of said first central core portion and said side core portion, and with said second end of said tube adjacent said end portion of said core, so that said first electrically conductive layer is formed into an electrically open single turn about said central core portion, and so that each of said second electrical conductors also defines an open single turn about said central core portion, with a first end of each of said elongated second electrical conductors adjacent a second end thereof, said first and second ends of said second electrical conductors being substantially coplanar with one of said first and second broad sides of said magnetically permeable core when said tube is fitted over said central portion of said core;

a flexible interconnection sheet overlying said one of said first and second sides of said magnetically permeable core and said first and second ends of said second elongated electrical conductors, said flexible interconnection sheet including a layer of electrically conductive material defining at least interconnections between said first and second ends of said elongated second electrical conductors, said interconnections being defined in a manner which electrically interconnects at least the first end of one of said elongated second electrical conductors to the second end of a nearby one of said elongated second electrical conductors, to thereby define a single continuous electrical conductor wound in multiple turns about said central core portion; and electrically conductive means coupled to mutually adjacent portions of said electrically conductive first layer, to thereby define a single turn of electrical conductor about said first central core portion of said magnetically permeable core.

6. A structure according to claim 5, wherein said flat, magnetically permeable core further defines at least a second slot extending inward from said edge, parallel with said first slot, to thereby define second side portion lying generally adjacent said second slot, said second side portion lying parallel with said central core portion, and said flat, magnetically permeable end portion being coplanar with said central portion of said magnetically permeable core and with said first and second side portions of said magnetically permeable core.

7. A method for fabricating a magnetically coupled winding structure comprises the steps of:

defining an electrically conductive primary winding conductor affixed to one broad side of a flat, flexible dielectric substrate;

defining a plurality of electrically conductive regions on the other broad side of said dielectric substrate, each of said regions being elongated in the direction of an axis of elongation, and said axes of elongation being parallel;

rolling said dielectric substrate into the general shape of a tube defining an interior aperture and a parting line, whereby said axes of said elongated regions are formed into curved figures, said tube having an axis which is orthogonal to the plane of said figures, said elongated regions being electrically discontinuous along said parting line;

causing said aperture of said tube to surround a leg of a magnetically permeable core;

stitching together mutually adjacent ends of said elongated regions by creating through vias which interconnect ends of said elongated regions in a manner which forms at least some of said elongated regions into a continuous turn of winding about said leg.

8. A method according to claim 7, wherein said step of causing said aperture to surround said leg includes the step of forming said dielectric substrate with said electrical conductors around said core.

9. A method according to claim 7, wherein said step of causing said aperture to surround said leg includes the step of forming said dielectric substrate with said electrical conductors into a tube-like form in the absence of said magnetically permeable core.

10. A method according to claim 9, wherein said step of forming said dielectric substrate includes the step of forming said dielectric substrate over a mandrel having dimensions similar to those of said leg of said magnetically permeable core.

11. A method according to claim 7, wherein said step of stitching includes the step of juxtaposing a second dielectric substrate over at least a portion of said parting line, said second dielectric substrate including at least a second conductive region, and creating each stitch by creating a first through via in contact with an end of one of said elongated regions and with said second conductive region, and a second through via in contact with an end of another one of said elongated regions and with said second conductive region.

* * * * *